United States Patent [19]

Astl

[11] 4,089,144

[45] May 16, 1978

[54] BUILDING ELEMENT

[76] Inventor: Franz Astl, Klinkstr. 8, 6332 Kufstein, Austria

[21] Appl. No.: 754,263

[22] Filed: Dec. 27, 1976

Related U.S. Application Data

[63] Continuation-in-part of Ser. No. 563,121, Mar. 27, 1975, abandoned.

[30] Foreign Application Priority Data

Mar. 28, 1974 Austria ..... 2584/74

[51] Int. Cl.[2] ..... E04B 1/02; E04C 1/10

[52] U.S. Cl. ..... 52/281; 52/284; 52/309.4; 52/568; 52/586; 52/496; 52/595; 46/23

[58] Field of Search ..... 46/23, 26, 31, 20; 52/595, 597, 426, 562, 567, 568, 281, 309.4, 233, 284–286, 495, 496, 580, 586, 309.14

[56] References Cited

U.S. PATENT DOCUMENTS

| | | | |
|---|---|---|---|
| 251,763 | 1/1882 | Carpenter | 46/28 |
| 392,625 | 11/1888 | Miller | 52/496 |
| 1,194,776 | 8/1916 | Oldfield | 52/284 |
| 1,970,414 | 8/1934 | Brown | 52/281 |
| 1,991,145 | 2/1935 | Fuchs et al. | 52/586 |
| 2,880,470 | 4/1959 | Pickersgill | 46/25 |
| 3,603,060 | 9/1971 | Kay | 52/284 |
| 3,742,665 | 7/1973 | Henry et al. | 52/233 |
| 3,849,960 | 11/1974 | Henry et al. | 52/569 |
| 3,866,371 | 2/1975 | Falconer | 52/281 |

FOREIGN PATENT DOCUMENTS

| | | | |
|---|---|---|---|
| 262,567 | 6/1968 | Austria | 52/233 |
| 807,425 | 10/1936 | France | 52/568 |
| 137,914 | 2/1934 | Germany | 52/592 |
| 82,743 | 10/1919 | Switzerland | 52/727 |
| 267,645 | 4/1950 | Switzerland | 52/496 |
| 270,760 | 12/1950 | Switzerland | 52/588 |

*Primary Examiner*—James L. Ridgill, Jr.
*Attorney, Agent, or Firm*—Wenderoth, Lind & Ponack

[57] ABSTRACT

A building element for the production of internal and external walls, parapets, fences, sheathings, and the like includes two flat boards joined by bars, and tongue elements. The dimensions of the elements are coordinated to permit many different ways of assemblage of the flat boards in order to form prefabricated building elements which are designed for specific purposes.

14 Claims, 17 Drawing Figures

BUILDING ELEMENT

This is a continuation-in-part of application Ser. No. 563,121, filed Mar. 27, 1975 now abandoned.

BACKGROUND OF THE INVENTION

The present invention relates to a building element for the production of dismountable internal and external walls, fences, parapets, sheathings, and the like.

As everywhere in corresponding production circles, the reduction of costs can nowadays only be attained by a large scale efficient design modernization. One of the factors of such a modernization is the possibility of assembling larger units from a number of elements, whereby the elements are simple and can be produced on an assembly line and the small number of different constituent members does not demand large stocks with many different items to be maintained.

Especially in building constructions, attempts are made to reduce costs as much as possible, as this is the only way to offset, at least partially, highly increased prices. A number of suggestions have already been made in this direction, but none have been absolutely satisfactory, as the elements they proposed either did not meet the demands described above or were so unhandy that only a small number of them could be transported on one vehicle, thus increasing the costs of transportation from the place of production to the building site.

For this reason many producers resorted to the production of smaller prefabricated parts which then are assembled at the building site to form larger building elements. Thus, German Pat. No. 1 913 292 describes a remountable and dismountable separating or partition wall consisting of single members of preferably rectangular form which can be easily transported. These elements are provided with grooves at their shorter sides, into which grooves tongues are placed to bridge the separation gap and to stabilize walls made of such elements, as the tongues connect adjacent elements. In order to improve stability, this proposed construction provides also that the separation gaps between adjacent elements be dislocated laterally. Apart from the fact that the obviously large building elements are difficult to transport, the elements used for building such a wall are not dimensioned to permit different patterns of combination, and therefore it is necessary to maintain a stock containing a larger number of elements with different measurements for varied building designs.

German Pat. No. 1 659 012 suggests a separation wall of prefabricated parts including supporting profiles and wall panels attached thereon. For the anchoring of these wall panels the supporting profiles are provided with one or two vertical profile rails with profile rods of a specially shaped cross-section on one or both of its sides, which profiles fit into corresponding grooves of the panels when assembled. However, in this case also the large wall panels cause problems of transportation, and the production of the profile rails with the profile rods on the supports and of the grooves in the panels not only demands a great deal of work during assembly at the site, but also causes the further disadvantage that the single member parts which consist of wood are prone to warping, especially if stored for a certain time, which results in the rods and the grooves not properly fitting together. This proposed arrangement also does not provide the single member parts with dimensions which have a fixed relation to each other, thus offering only a limited number of varied possibilities for assemblage of such a wall.

SUMMARY OF THE INVENTION

Therefore, the object of the present invention is to create a building element for the production of walls of the kind specified above, but which avoids the disadvantages of known elements, and which consists of simple and therefore economically produceable parts.

A further object of the invention is to provide such a building element, the constituent parts of which can be easily and handily transported, thus making it possible to use available loading capacity to the utmost efficiency.

An additional object of the invention is to provide such a building element, the constituent parts of which have dimensions which permit their being assembled in connection with other elements of the same kind in various ways, thus forming different final structures according to the intended purpose.

According to the present invention these objects are achieved by providing two flat boards, preferably ledges, of the same type and size spaced from each other, and connected to form an entity, by means of bars. The free edge surfaces of the bars are situated at a certain distance from the longitudinal edges of the flat boards, such distance being preferably half the breadth of a tongue element insertable between the flat boards and abutting against the bars.

This building element can be used for both inner and outer walls, parapets of balconies, fences, and the like, and it is also possible to produce esthetically appreciable patterns, since due to the fixed relationship of the dimensions of the constituent parts or elements of the building element a builder may connect the elements according to the invention in horizontal or vertical positions, or provide alternate sections of vertically and horizontally arranged elements.

A preferable embodiment provides that the bars be represented by square plates and the front sides or ends of the tongue elements be correspondingly shaped squares of the same size. With this embodiment of bars and tongue elements it is easy to connect the flat boards in any arrangement, as, due to the square bars and tongue elements, it is not necessary to pursue only a single connection arrangement.

It would, however, not exceed the scope of the invention to have the bars formed by rectangular plates and provide the tongue elements with a cross-section of corresponding shape and size. In this case the number of assembly possibilities is more limited, although this embodiment of the building element according to the invention often offers desired advantages.

The connection between the bars and the inner surfaces of the flat boards can be effected in any desired manner. If the building element consists of wood, plastic, or the like, the bars could be provided with projections which are insertable into clearances or recesses in the flat boards. If a building element according to the invention is made, e.g. of concrete, the flat boards and the bars could be integrally moulded. This latter possibility naturally would also apply if the elements are formed by the injection moulding of plastic material.

In one possible vertical arrangement of the flat boards, the boards are put onto a floor ledge the breadth of which is equal to the distance between the two flat boards, while the upper ends of the flat boards are guided in a ceiling ledge of the same breadth. In this case the flat boards must be made in a way that those surfaces of the bars which are adjacent and parallel to the end surfaces of the flat boards are arranged at a given distance from such end surfaces, such distance being equal to the height of the floor and ceiling ledges in order to provide that the free ends of the flat boards lie close to the floor and reach directly to the ceiling. Otherwise, these free ends would have to be covered by a special covering or moulding member.

A preferred embodiment of the invention provides that the surfaces of the bars which are adjacent and parallel to the end surfaces of the flat boards be at a given distance from such end surfaces which corresponds to the thickness of the flat boards. As the tongue elements belonging thereto have a thickness twice such distance, the flat boards can be inserted onto a tongue element from both sides thereof, both in the vertical and in the horizontal positions, with the front surfaces of two adjacent or superposed flat boards lying closely together.

The flat boards as well as the bars can be made of wood, plastic material, metal, or the like. This material can also be chosen for the tongue elements. Especially for separating walls or for outer walls, however, it is preferable to use heat and/or sound insulating material both for the tongue elements and for the bars.

In accordance with a further feature of the present invention the connection of the bars to the flat boards may be by dovetail configured ends on the bars fitting in correspondingly shaped recesses in the flat boards. This provides additional strength to the assembly and avoids separation of the flat boards from the bars during shrinkage if the flat boards are formed of wood.

In a yet further feature of the present invention, when the flat boards and bars are formed of wood, the grain of the bars and flat boards respectively extend longitudinally of each element. This provides the advantageous characteristic that a closed or somewhat circular line of forces is achieved extending longitudinally through the flat boards and the bars, thus providing additional strength to the overall assembly.

According to a further feature of the present invention an attachment element such as a nail may be extended through the bar and into the tongue, thus additionally connecting the elements. The nail is positioned between the two flat boards, such that it is not visible in the finished construction.

In a yet further feature of the present invention the tongues may have recesses therein to receive supplemental or smaller tongue elements which are spaced to extend into the space between the flat boards and to abut against the inner surfaces thereof. This arrangement is particularly advantageous when employed in combination with the above discussed feature of the use of a fastening member such as a nail. The tongue may be designed to have recesses in any or all of the sides thereof to receive the supplemental tongue elements.

BRIEF DESCRIPTION OF THE DRAWINGS

Several embodiments of the invention are described hereinafter with reference to the attached drawings, but the invention is not meant to be limited to these specific structural arrangements.

DETAILED DESCRIPTION OF THE INVENTION

Figure 1:
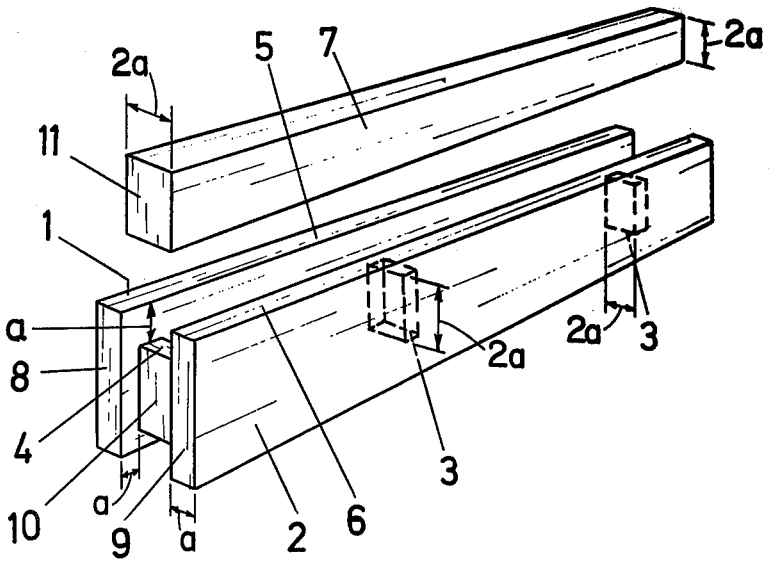
FIG. 1 is a perspective view illustrating a building element consisting of flat boards and a tongue member before assemblage.

FIG. 1 shows the features and components of the building element according to a basic embodiment of the invention. The building element includes two flat boards 1 and 2 which are spaced from each other by bars or plates 3. In this basic embodiment the bars 3 consist of square plates spaced at a distance *a* from the longitudinal edges of the flat boards 1 and 2. Distance *a* equals the thickness of boards 1 and 2. Between the flat boards 1 and 2 tongue elements 7 with a square cross-section can be inserted, which tongue elements contact the edge surfaces 4 of the bars 3. The length of the side of the square of tongue element 7 is twice the distance *a*, and thus the tongue element extends beyong the longitudinal edges 5 and 6 of the flat boards by the distance *a*, thus permitting another assembly of flat boards 1 and 2 to be placed thereon. In case more connections of this type are continuously assembled, the outer surfaces of the adjacent flat boards form a continuous wall. In that case the length of the tongue elements 7 equals the length of the flat boards 1 and 2, but the tongue elements, if necessary, can also be shorter. In case the tongue elements 7 and the flat boards 1 and 2 have the same length, the front or end surfaces 8 and 9 of the latter and the front surfaces 11 of the tongue elements 7 form one plane. In this basic embodiment the square surfaces 10 of the bars 3 which are parallel to front surfaces 8, 9 and 11 are also arranged at a distance *a* from the front surface 11.

As can be seen from this basic embodiment of a building element according to the invention, the relationship between the dimensions of the constituent parts is very important in order to permit various arrangements for connecting them to form predetermined different prefabricated constructions. The dimensions need not be necessarily the same as described in the basic embodiment above. Thus, e.g. the bars 3 can be rectangular plates, and therefore the tongue elements 7 would have a corresponding cross-section. It can be easily derived that there are many possibilities for variation, all of which add up to the principle that the basic dimensions of the constituent members of the building element according to the invention reappear either in its original size or in a multiple thereof.

In the following several examples are given of specific structures which can be fabricated by the building element of FIG. 1 according to the invention. Naturally these examples represent only a small selection of the possibilities for which it can be used. These specific examples also suggest that such a building element need not be made exclusively of a given material. Furthermore, the building element can also have other dimensions than those described above in the basic embodiment.

Figure 2:
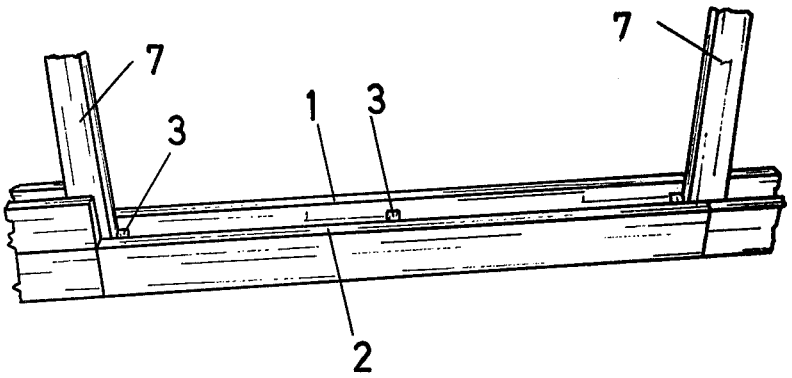
FIGS. 2 and 3 are perspective views respectively illustrating a horizontal and a vertical arrangement of the flat boards to form walls.

Thus FIG. 2 shows the use of the building element for the production of a sheathing for visible concrete surfaces, wherein the flat boards 1 and 2 are arranged horizontally and the tongue elements 7 are inserted vertically. As the sheathing can be fastened without any screws, hooks, nails or the like, the expensive sheathing elements are not damaged as was the case with conventional sheathing plates which became unservable after a few applications. Furthermore, the building element according to the invention offers the advantage that both its outer surfaces can be used. As in practice the breadth of the flat boards used for such a sheathing is 10 cm. according to the new modular order ONORM B 101 o, a building element according to the invention can also be used as a unit of measure in the building.

Figure 3:
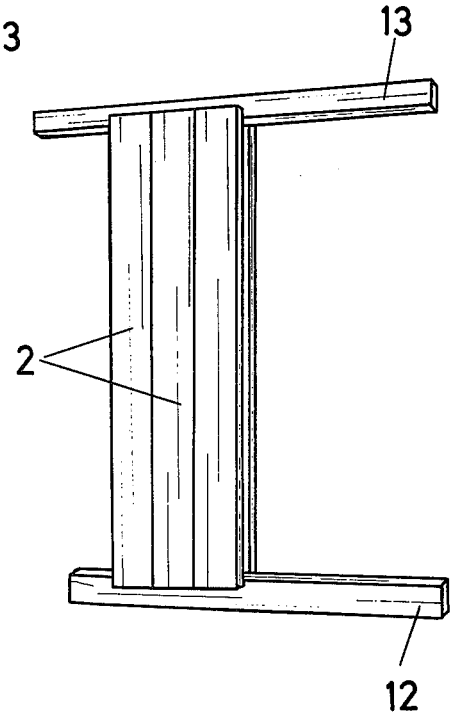

FIG. 3 shows the use of the building element of FIG. 1 for the production of a separation wall which could be both an inner and an outer wall. In this case the flat boards 1 and 2 are inserted into a floor ledge 12 and a ceiling ledge 13, which contact the surfaces 10 of the bars 3. The bars 3 can be longitudinally arranged with respect to boards 1 and 2 to permit the front surfaces 8 and 9 of the flat boards 1 and 2 to lie close to the floor and the ceiling, thus avoiding the necessity of covering these otherwise free ends. It is easily possible to lead water pipes or electric or gas conductors between the flat boards 1 and 2. The interspace can also be filled with insulating material in order to achieve better heat and sound insulation, although in many cases the air between the two flat boards might be sufficient insulation. The insulating material used can, e.g., be foamable plastic material injected into the interspace of a finally assembled wall or the like.

Figure 4:
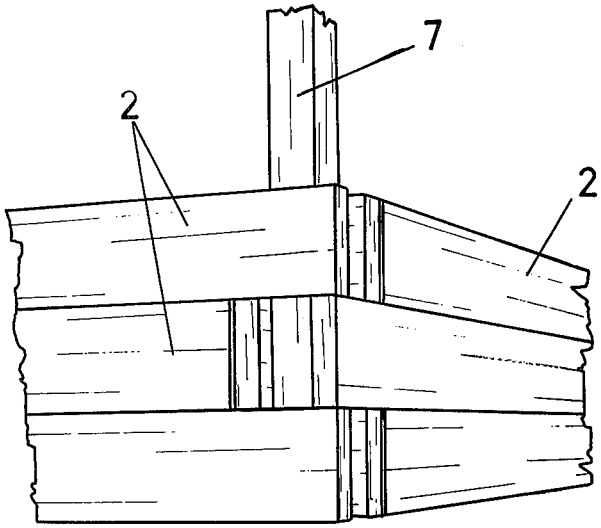
FIGS. 4 and 5 are perspective views illustrating possible corner connections of building elements according to the invention.
Figure 5:
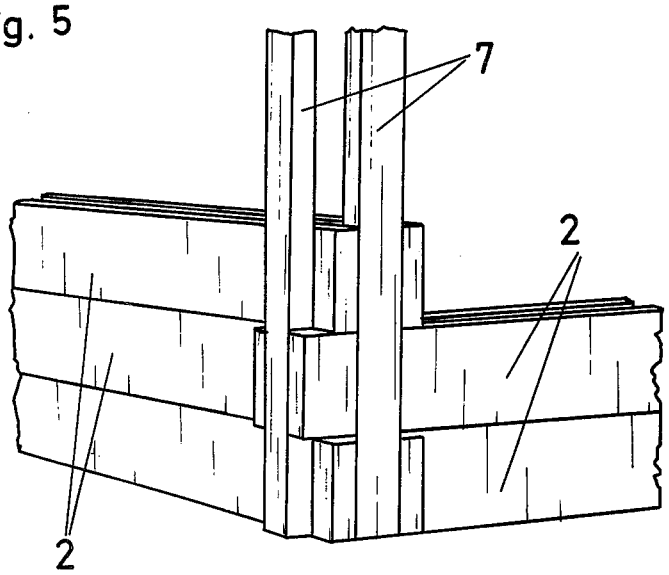

Naturally such walls can also be made of horizontal flat boards 1 and 2 or a combination of alternate horizontal and vertical parts. Such an arrangement of horizontal elements is shown in FIGS. 4 and 5 which also show possible arrangements of corner connections. The production of separating or partition walls consisting of elements according to the invention offers the advantage that wall-to-wall carpets or paperings of the ceiling can be made before these walls are put up, as the walls can be assembled without any destruction of the carpet or paper.

Figure 6:
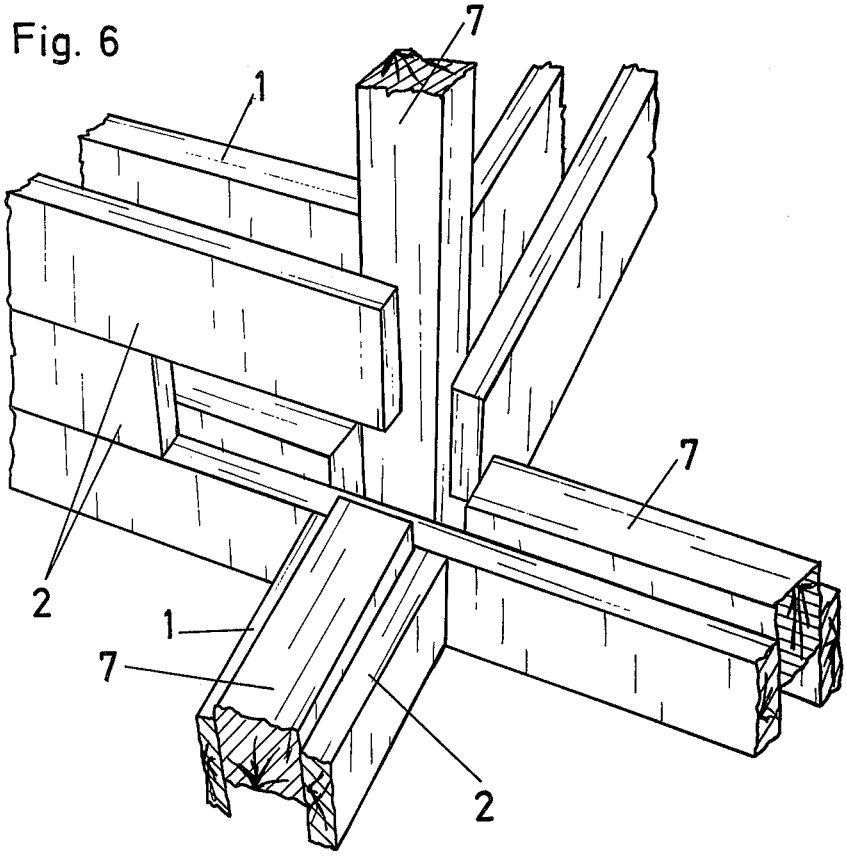
FIG. 6 is a perspective view illustrating a cross connection of such elements at a joint of four rooms.

FIG. 6 shows a possible construction of a cross connection of building elements according to the invention, but such connection may be formed by several varied possibilities as in the corner connections according to FIGS. 4 and 5. Such construction embodiments not only serve the specific construction purpose, but also achieve an esthetic effect, produced by overlapping or other connections.

Figure 7:
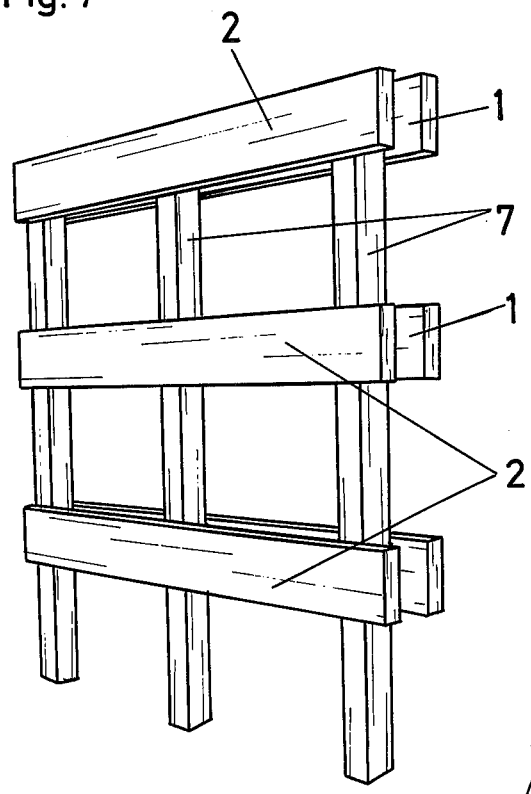
FIG. 7 is a perspective view illustrating an interrupted wall, for instance a parapet, railing, fence, trellis, wooden grill or the like, formed of building elements according to the invention.
Figure 8:
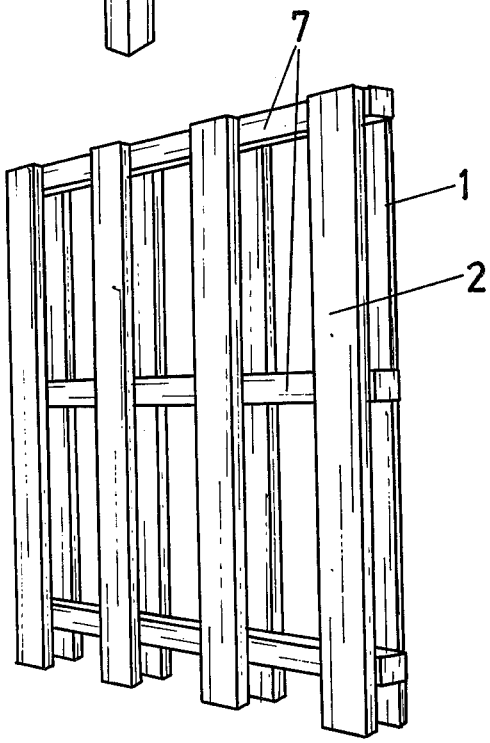
FIG. 8 is a view similar to FIG. 7 of a modification thereof.

FIGS. 7 and 8 show connection of the building elements to form interrupted walls, balcony railings, parapets, fences, trellises, wooden grills or the like. In this type of construction also there are a great number of different ways to connect the elements in order to achieve constructions which serve their respective purpose and also achieve the esthetic demands of a design.

Figure 9:
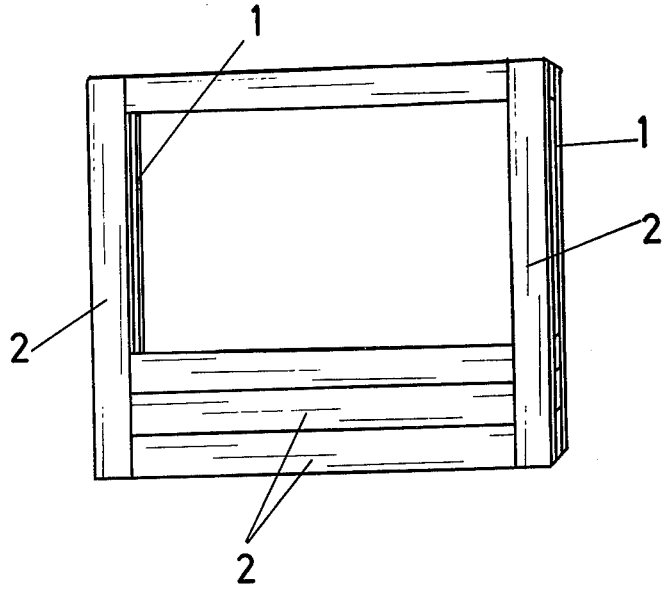
FIG. 9 is a perspective view of the use of building elements according to the invention forming an opening for a window.

FIG. 9 illustrates the use of the building elements according to the invention for the production of openings for windows or doors. In this case the wall elements extend vertically, and the railings and the lintels are arranged horizontally. On assembly, the window bands as well as the window and door casings are simply inserted in the manner of further wall elements.

Figure 10:
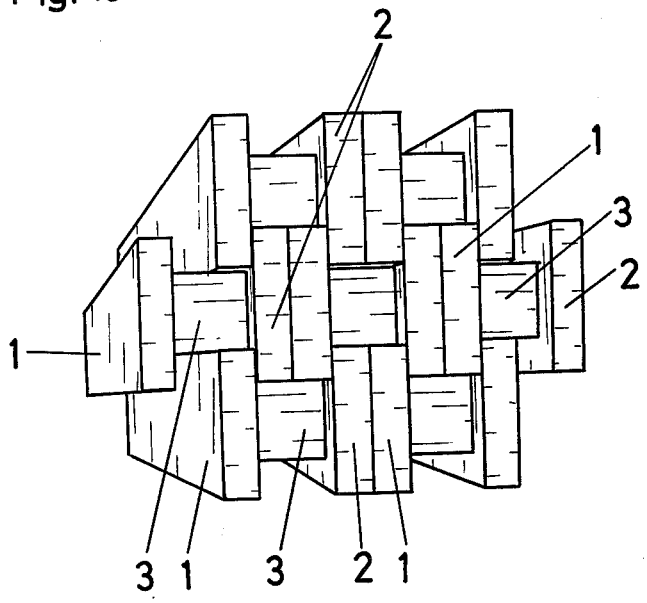
FIG. 10 is a perspective view illustrating an arrangement for storing building elements according to FIG. 1 within as little space as possible for storage or for transport.

As described above, a significant advantage of the building element according to the invention lies in the fact that it saves transportation costs, as it can be stored with the utmost effective use of the space available. This is clearly shown by FIG. 10. In this case the prefabricated flat boards 1 and 2 with their bars 3 are placed one beside the other in a row, whereby a superposed row is dislocated laterally by the distance *a*, and the surfaces 4 of the bars 3 of the superposed row rest on the narrow longitudinal sides 5 and 6 of the flat boards 1 and 2 of the lower row. At the same time the surfaces 4 of the bars 3 of the lower row of elements serve as support for the narrow longitudinal sides 5 and 6 of the upper row of flat boards 1 and 2. The tongue elements 7 are transported separately in closely joined block formation.

A second embodiment of the building element in accordance with the present invention is illustrated in FIGS. 11–17 of the drawings.

In this embodiment of the invention, each of the bars 3 has at the ends 17 thereof to be attached to the flat boards 1 and 2 a dovetail cross-sectional construction. Flat boards 1 and 2 have correspondingly shaped recesses therein to receive the doevtail ends 17 of the bars 2.

Figure 11:
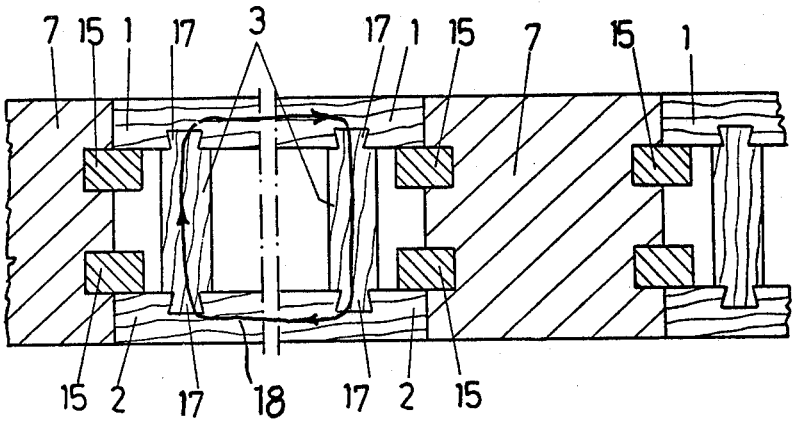
FIG. 11 is a cross-sectional view through a construction formed of a building element in accordance with a second embodiment of the present invention.

It is particularly advantageous in accordance with this embodiment of the invention that bars 3 and flat boards 1 and 2 be formed of wood and that the grain of these elements be provided to extend in the manner shown in FIG. 11. That is, the grain of each of the elements respectively extend longitudinally of each element.

This grain alignment arrangement and the dovetail connection between flat boards 1 and 2 and bars 3 provides the advantage that the flat boards 1 and 2, which are relatively long in dimension, are prevented from arching outwardly upon shrinkage of the wood, and thus the flat boards 1 and 2 are prevented from becoming disconnected from the bars 3.

Furthermore, the grain alignment arrangement results in a closed path of forces being exerted on the elements, such as during shrinkage thereof and as a result of building structure stresses, as illustrated by arrow 18 in FIG. 11. It will be apparent that the arrangement of the embodiment of the building element shown in FIG. 11 provides substantial strength advantages.

In accordance with a further feature of the present invention, an attachment device, such as nail 14, may be used to supplement the assembly of the constituent parts of the building element. Specifically, nail 14 may be extended through an end-most bar 3 into tongue 7. Nail 14 does not unpleasantly affect the esthetic quality of the resultant building structure, since it is inserted at a position between flat boards 1 and 2, and therefore will not be visible in the finished device. It will be apparent that connecting elements such as nail 14 may be employed in the embodiment of the building element of FIG. 1 of the present invention.

Figure 12:
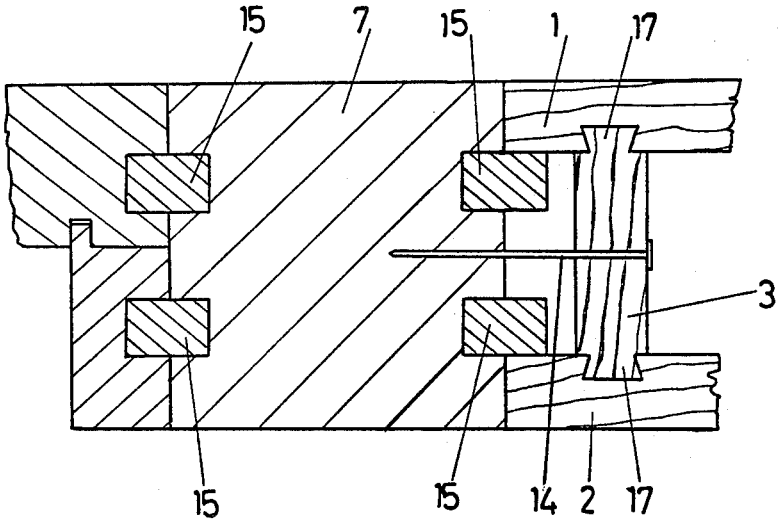
FIG. 12 is a cross-sectional view through a portion of the arrangement of FIG. 11 showing an additional attachment and assembly feature.

In accordance with a further feature of the present invention, and as illustrated in FIGS. 11 and 12, tongues 7 may be assembled to flat boards 1 and 2 by means of smaller or supplemental tongue elements 15 which are fitted in recesses 16 in appropriate sides of tongues 7. As shown in FIG. 11 of the drawings, tongue elements 15 are fitted in tongue 7 at such positions to extend into the space between flat boards 1 and 2 and to bear against the respective inner surfaces thereof.

A particular advantage of this feature of the present invention is that the entire interspace between flat boards 1 and 2 may be filled with a heat and/or sound insulation material, such as foamed plastic. A further advantage of this arrangement is that gas and water pipes, heating conduits and electrical conduits may be positioned within the interspace between flat boards 1 and 2, after which the insulation material can be inserted, for example by injection.

Figure 13:
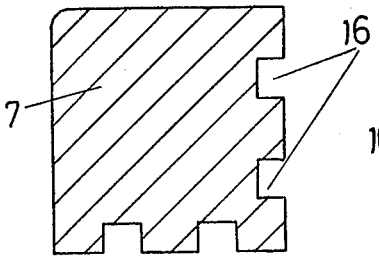
FIGS. 13–17 are cross-sectional views through tongues showing different possible arrangements of recesses in the sides thereof.
Figure 14:
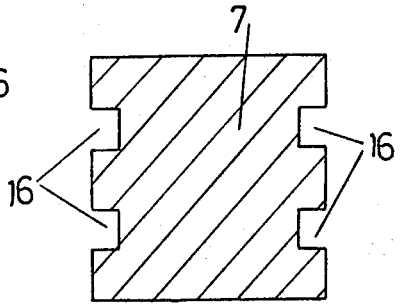
Figure 15:
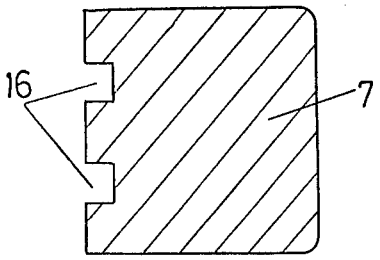
Figure 16:
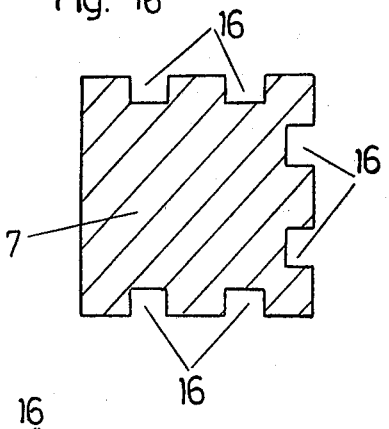
Figure 17:
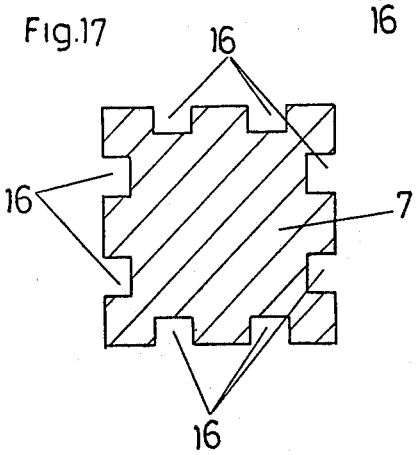

It will be apparent from FIGS. 13–17 of the drawings that recesses 16 may be formed in any of the sides of tongues 7 as desired. For instance, recesses 16 may be formed in two adjacent sides of tongue 7, as shown in FIG. 13. Recesses 16 may be formed in two opposite sides of tongue 7, as shown in FIG. 14. Also, recesses 16 may be formed in one, three or four sides of tongue 7, as respectively shown in FIGS. 15–17.

It will be apparent that the arrangement of recesses 16 and supplemental tongue elements 15 could be employed in the embodiment of FIG. 1 of the present invention, without also employing the dovetail connection arrangement between bars 3 and flat boards 1 and 2. Those of ordinary skill in the art will readily understand various possible combinations of the features of the embodiments of the present invention.

It can easily be seen that there are many different possible ways to use the building element according to the invention, and the scope of the possible variations is enlarged by the fact that even more possibilities arise by the use of different materials as e.g. wood, plastic, metal, concrete or the like for the elements, or even by the use of different materials in one element. All these use possibilities are included within the scope of the invention.

What is claimed is:

1. A building assembly for the production of dismountable internal and external walls, fences, parapets, sheathings, and the like; said building element comprising:

two elongate parallelly extending flat boards of the same size;

at least two plates extending transversely of and fixed to said two flat boards to space said two flat boards from each other to form an entity;

each said plate having first and second opposite edge surfaces fixed to respective of said flat boards;

each said plate having a third edge surface at a first position spaced by a first given distance from first longitudinal edges of said two flat boards;

each said plate having a fourth edge surface, opposite to said third edge surface, at a second position spaced by a second given distance from second longitudinal edges of said two flat boards;

each said plate being formed of a single element between said respective first and second positions;

said first given distance being equal to said second given distance;

a tongue element insertable between said two flat boards in a position to contact one of said third and fourth edge surfaces of each of said plates, the breadth of said tongue element being equal to twice said first given distance and equal to twice said second given distance; and the distance between the end surfaces of said two flat boards and the surfaces of said plates parallel and adjacent to said end surfaces of said two flat boards being equal to one half the breadth of said tongue element.

2. A building element according to claim 1, wherein the space between said flat boards is filled with foamed plastic insulating material.

3. A building element according to claim 1, wherein said plates comprise square plates, and the end surfaces of said tongue element are in the form of a square of the same size.

4. A building element according to claim 1, wherein said plates comprise rectangular plates, and the end surfaces of said tongue element are in the form of a rectangle of the same size.

5. A building element according to claim 1, wherein said plates are formed of a heat insulating material.

6. A building element according to claim 1, wherein said given distance equals the thickness of said two flat boards.

7. A building element according to claim 1, wherein said flat boards and plates are wood, the grain of each plate and flat board extending longitudinally thereof and forming an approximately circular course between said plates and flat boards.

8. A building element according to claim 1, wherein the ends of said plates are dovetailed and are inserted into correspondingly shaped recesses in said flat boards.

9. A building element according to claim 1, further comprising supplemental tongue elements fitting into recesses in said tongue element and extending into the space between said flat boards and abutting the inner surfaces thereof.

10. A building element according to claim 9, wherein said tongue element has recesses in more than one side thereof.

11. A building element according to claim 1, wherein said plates are formed of sound insulating material.

12. A building element according to claim 1, wherein said tongue element extends transverse to said flat boards adjacent ends thereof, and further comprising at least one nail extending through one of said plates, from a position between said flat boards, into said tongue.

13. A building element according to claim 12, further comprising supplemental tongue elements fitting into recesses in said tongue element and extending into the space between said flat boards and abutting the inner surfaces thereof.

14. A building element according to claim 13, wherein said tongue element has recesses in more than one side thereof.

* * * * *